United States Patent [19]

De Filippo et al.

[11] Patent Number: 4,786,377

[45] Date of Patent: Nov. 22, 1988

[54] PROCESS FOR ELECTROPLATING STEEL WIRES AND COATED WIRES THUS PRODUCED

[75] Inventors: Domenico De Filippo, Cagliari; Leo Ambrosio, Quartu Sant'Elena, both of Italy

[73] Assignee: Gencord SpA, Assemini, Italy

[21] Appl. No.: 44,089

[22] PCT Filed: Jul. 18, 1986

[86] PCT No.: PCT/IT86/00056

§ 371 Date: Mar. 19, 1987

§ 102(e) Date: Mar. 19, 1987

[87] PCT Pub. No.: WO87/00560

PCT Pub. Date: Jan. 29, 1987

[30] Foreign Application Priority Data

Jul. 19, 1985 [IT] Italy ..... 48380 A/85

[51] Int. Cl.[4] ..... C25D 5/50

[52] U.S. Cl. ..... 204/37.1; 204/28; 204/40; 204/44.2; 204/44.5; 204/44; 204/49; 204/55.1

[58] Field of Search ..... 204/44.2, 44, 44.5, 204/44.4, 55 R, 49, 44.7, 28, 29, 49, 40, 37.1

[56] References Cited

U.S. PATENT DOCUMENTS 1,918,159 1/1932 Weisberg et al. ..... 204/40

3,926,749 12/1975 Passal ..... 204/44.4

*Primary Examiner*—R. L. Andrews

*Attorney, Agent, or Firm*—Pollock, Vande Sande & Priddy

[57] ABSTRACT

Steel wire are electroplated with layers of copper/lead, then zinc, then nickel, followed by solid state diffusion of the layers by Joule effect.

9 Claims, 2 Drawing Sheets

PROCESS FOR ELECTROPLATING STEEL WIRES AND COATED WIRES THUS PRODUCED

The present invention relates to a process for electroplating steel wires as well as to the products thus obtained, which products can be employed for the manufacture of reinforcing structures for elastomeric material articles, and more particularly for tires.

More particularly, this invention relates to a process for coating steel wires with a thin layer of an alloy, containing copper, zinc, nickel and lead, by electroplating and subsequent diffusion by Joule effect.

BACKGROUND OF THE INVENTION

In the production of reinforced elastomeric materials, in particular of radial tires, wire cords have been employed up to the present time, as is well known, which cords are made up of steel wires coated by electroplating with brass, preferably of a composition between Cu/Zn=60/40 and Cu/Zn=70/30 (% by weight) at the amounts between 2 and 8 g/Kg of steel and of 1-2 μm thickness for a wire diameter between 0.75 and 1.40 mm. Such wires ar then wet-drawn according to a chipless procedure and employed for the production of said cords.

It it also well known that such cords, in addition to a high ultimate tensile stress and to a high flexibility, also show, during the curing process with a standard mix, an adhesion to rubber (or other elastomeric material) which is much larger than the value of adhesion that can be ascribed to the mere friction effect. At the present time such property is considered to stem substantially from the formation and growth of films of some hundred Å thickness of copper and zinc sulfides at the rubber/brass interface, as a consequence of the chemical reactions occurring during vulcanization.

On the other hand, it has been observed that the adhesion between steel and the coating is also of the same importance. Thus it is clearly evident that any physical or chemical phenomenon, such as for instance corrosion, which alters the state of surfaces, affects the cord/elastomer adhesion negatively.

Such drawback manifests itself frequently, because rubber mixes commercially employed in the production of tires are hardly ever anhydrous, and give rise during vulcanization to the formation of a ZnO film, in addition to sulfides films, and next, owing to material aging, to the formation of hydroxides with the consequent definitive separation of the cord from the rubber. This was shown by a prolonged treatment with overheated steam (120° C. or more), in the presence of chlorides.

In that case the examination of the state of surfaces put into evidence the presence of rust at the interface between steel and coating.

On the other hand, it is well known that car and truck tires are subjected during employment to severe mechanical stresses, especially at the highest speeds or in off-road runs.

As the safety of passengers and of load depends on tire reliability, it is necessary that the cord/elastomer adhesion be particularly strong, not only at the very beginning, but also during the full tire life.

SUMMARY OF THE INVENTION

Thus it is a main object of the present invention to provide a coating for steel wires that results in an improved starting adhesion cord/elastomer and that is stable in time, as a result of the increase in the corrosion resistance. It is another object to provide a coat for a wire which permits mechanical working of the wire and drawing of the wire without producing chips, and with no remarkable changes in the surface composition and in the continuity of the coating itself.

In accordance with the present invention there is provided a coating made up of copper, zinc, nickel and lead electrodeposited as successive layers on steel wires and then transformed into an alloy through solid state diffusion a Joule effect.

It is worthwhile observing that the present invention is not limited to the selection of the components mentioned above and of their percentage amounts in the alloy, but, in the formation of said coating, the present invention also sets forth the order and the manner in which the constituents of the alloy are to be plated onto the steel support. Namely, copper and lead are electrodeposited simultaneously in a first step, zinc is electrodeposited in the next step and then nickel is electrodeposited.

In such a way a four-component coating is obtained which, in addition to be unprecedented in the technical literature, also shows a very high corrosion resistance due to the presence of nickel, as well as a very high mechanical workability, which is ensured by the presence of lead.

The adhesion between said coating and the rubber, which adhesion in the case of the known brass-coated wires stems from the formation of copper and zinc sulfides films, is increased in the coating according to the present invention by the further formation of a nickel sulfide film.

DETAILED DESCRIPTION OF THE INVENTION

Figure 1:
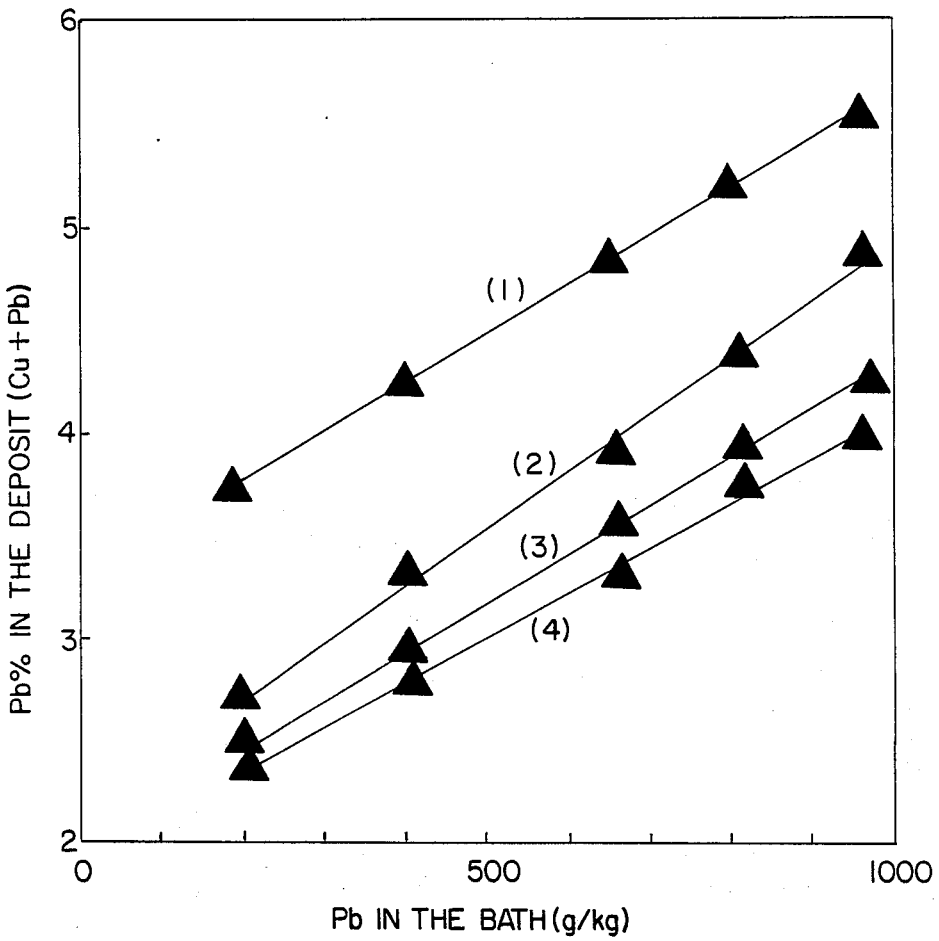
FIG. 1 is a graph showing the concentration of lead in the coating as a function of the concentration of lead in the bath.

The production of steel wires coated with a thin layer of the alloy according to the present invention can be carried out in any plant designed for continuous traditional type working processes, both preliminary and successive to the electroplating operation.

More particularly, steel wires of diameters between 0.75 and 1.4 mm, obtained by dry-drawing of a steel rod of 5.5 mm diameter are subjected before the electroplating process to a heat treatment carried out at about 1,000° C. in a furnace, and to a patenting process at a temperature between 500° and 600° C. After such treatment, the wire surface is drastically cleaned by passing it through a series of tanks containing 2M $H_2SO_4$ at 35° C., in which said wire takes on in turn positive and negative polarities with current densities between 700 and 800 A/dm$^2$. After such treatment and a suitable washing of the wire surface, such surface is brilliant and free from impurities and oxides, as can be proved by a check under a metallographic microscope.

As regards the final treatment, the wire coated according to the process of the present invention is cleaned by removing the surface oxides by means of a washing operation with 10% $H_3PO_4$ at 40° C. and then with water. Hot air drying is then performed, followed by winding of the wire and the transfer of the same to the drawing and stranding departments.

The basic feature of the present invention lies thus in the way of carrying out the electrodeposition operations of the above-mentioned alloy components on the steel wire support and of performing the diffusion process by Joule effect.

More specifically, the present invention concerns a process for the production of electroplated steel wires, intended for the manufacture of reinforcing structures for elastomeric material articles, especially for tires, said process being characterized by the following succession of operations:

(a) simultaneously electrodepositing copper and lead from an alloy bath on a steel wire, which has been previously subjected to the above-mentioned preliminary treatment, (b) electrodepositing zinc from a zinc plating bath, (c) electrodepositing nickel from a nickel plating bath, (d) solid state diffusion by Joule effect of the electroplated layers obtained in the steps (a), (b) and (c), washing steps being provided after each of the electroplating operations performed in the steps (a), (b) and (c).

Preferably the electroplating step (a) of copper and lead is carried out employing a pyrophosphate alloy bath of a new composition within the limits set forth in the following table 1, wherein the pertinent operative parameters are also reported.

TABLE 1

Composition of the alloy bath for the simultaneous electrodeposition of copper and lead and the pertinent operative conditions

| Composition of the bath | | |
|---|---|---|
| | concentration (moles/liter) | |
| ionic species | maximum | minimum |
| $Cu(P_2O_7)_2^{6-}$ | 0,7 | 0,3 |
| $Pb(P_2O_7)_2^{6-}$ | $10 \cdot 10^{-3}$ | $0,25 \cdot 10^{-3}$ |
| $P_2O_7^{4-}$ | 0,2 | 0,1 |
| $HP_2O_7^{3-}$ | 0,2 | 0,1 |
| $NH_3$ | 0,1 | 0 |
| $NO_3^-$ | 0,1 | 0 |
| $Cu(HP_2O_7)_2^{5-}$, $CuP_2O_7^{2-}$, $H_2P_2O_7^{2-}$, $Pb(P_2O_7)^{2-}$ | trace amounts | |

Operative conditions t = 50 ± 2° C.; pH = 8.8; $Cu/P_2O_7$ ratio = 1/7 by weight; current density = 10–12 A/dm$^2$; countercurrent stirring.

A typical composition example according to the present invention, which composition has been used in many experimental tests, is the following one: $K_4P_2O_7.3H_2O$, 360 g/l; $Cu_2P_2O_7.5H_2O$, 90 g/l; lead ion, 50–300 ppm; $H_4P_2O_7$, q.s. to pH=8.8 (at 25° C.); $NH_3$, 3 g/l; $NO_3^-$, 6 g/l.

The amount of lead contained in the coating depends: (a) on the amount of the $Pb(P_2O_7)_2^{6-}$ ion contained in the bath; (b) on the current density, as can be observed from the results of a series of experimental tests reported in FIG. 1 of the enclosed drawings.

In FIG. 1, the ordinates show the concentrations of metal ion in the coating as a function of the concentrations of the ion in the galvanic bath as the abscissas (g/Kg), for four different values of the current density (A/dm$^2$), i.e., 8.6 (1); 13.2 (2); 16.1 (3); 19.3 (4). Thus it can be clearly seen that the concentration of metallic lead in the coating is proportional to the concentration of the ion in the galvanic bath and it decreases on increasing the current density.

Accordingly, by establishing the value of the operative current density, it is quite easy to obtain, by interpolation of the curves plotted in FIG. 1, the required value of the $Pb(P_2O_7)_2^{6-}$ concentration that results in a coating having a definite percentage of such metal.

As regards the anodic process, the anodes employed are made up of electrolytic copper. Since in the case of the simultaneous electrodeposit (co-electrodeposit) of copper and lead the anodic current yield could be higher than the cathodic current yield referred to copper, an undesired increase in the concentration of the cupric ion can be avoided employing a parallel-connected electrolysis tank wherein the discharge of the excess copper is performed between inert metal electrodes. The concentration of the lead ion may be monitored and suitably restored through the addition of the most suitable salts; in all experimental tests the nitrate salt was employed (the nitrate ion, which performs the function of a depolarizing agent, undergoes a constant consumption due to cathodic reduction; lead nitrate additions make up fully or partially for such consumption).

As regards the zinc electrodeposit (step b), an acid bath containing sulfuric acid is preferably employed, which bath has the composition reported in Table 2, wherein the pertinent operative parameters are also shown.

TABLE 2

| Zinc plating bath | | |
|---|---|---|
| | Concentration (moles/liter) | |
| Ionic species | maximum | minimum |
| $Zn^{2+}$ | 2.0 | 0.7 |
| $SO_4^{2-}$ | 2.5 | 1.0 |

Operative conditions t = 20–40° C.; pH = 3.0 ± 0.5; current density 10–20 A/dm$^2$; countercurrent stirring.

Anodic and cathodic current yields are close to 100%. Anodes are made up of 99.9% zinc.

The electrodeposit of nickel (step c) is carried out preferably from an acid bath having the composition shown in Table 3, wherein the pertinent operative conditions are also put into evidence.

TABLE 3

| Zinc plating bath | | |
|---|---|---|
| | Concentration (moles/liter) | |
| Chemical species | maximum | minimum |
| $Ni^{2+}$ | 1.5 | 0.7 |
| $SO_4^{2-}$ | 1.3 | 0.5 |
| $Cl^-$ | 0.5 | 0.1 |
| $H_3BO_3$ | 0.6 | 0.3 |

Operative conditions t = 30–60° C.; pH = 3.5 ± 0.5; current density 2–10 A/dm$^2$; countercurrent stirring.

Anodes are made up in each case of 99.9% pure nickel foil.

A specific example of the nickel plating bath according to the invention is as follows: $NiSO_4.7H_2O$, 330 g/l; $NiCl_2.6H_2O$, 45 g/l; $H_3BO_3$, 38 g/l; pH=3.5; t=50±1° C.; (specific conductivity: 70 mS at 50° C.).

As already mentioned above, the various layers obtained in the galvanic electroplating operations disclosed previously are subjected, after a final washing with cold water, to a reciprocal diffusion by Joule effect (d), by applying to the wire a suitable voltage value, for instance by means of three stainless steel rolls; thus a first heating step is realized and afterwards a second soaking step is performed; the ratio between the length of the first section and that of the second one is of about 1:2.

The values of voltage and current density required for a correct diffusion process depend:

(1) on the wire diameter; (2) on the thickness of the coating; (3) on the running speed of the wire; (4) on the absolute and relative values of the lengths of the heating and soaking sections. Such values for the coatings according to the present invention disclosed in the following are not much different from those usually employed for the coating of steel wires with Cu and Zn. However, they are to be determined empirically by checking, at a steady-state condition, the obtainment of the temperature value that ensures a complete homogenization of the coating, through the observation of the coating colour which becomes bright yellow in the absence of nickel, whereas at increasing nickel concentrations it takes on lighter tones (till the silver white tone). For indicative purposes, the following values are reported which were obtained in pilot plant experimental tests and which were optimal:

A=27.5±0.5; V=2.1±0.1 at running speeds of 2 m/min.; wire diameters 1.4 mm; coating of 4.2 g/Kg, containing 3% Ni.

Coatings so obtained have an average composition between the following minimum and maximum values:

Cu: 59–70%
Zn: 30–33%
Ni: 0.75–8%
Pb: 0.2–2% and, in the case of application to steel wires under the operative conditions mentioned above, they give rise to final products having the characteristic features of the present invention.

The following Table 4 shows for exemplification purposes the results in a number of experimental tests performed on steel wires of 1.3 mm diameter coated with a minimum amount of 3.7 g/Kg and a maximum amount of 4.4 g/Kg of the alloy of the average composition mentioned above. Such coating shows rubber adhesion values always comparable to those of a 69/31 brass coating (such coating being considered as a reference and being obtained under the same operative conditions); at nickel concentrations between 0.75 and 3.0% the values of the adhesion strength to rubber show a sharp improvement.

TABLE 4

| Test No. | Analytical results obtained with a 1.4 mm diameter wire: % composition of the alloy Cu | Zn | Ni | Pb | alloy amount g/kg | CR Kg | CRS Kg/mm² | ΔCRS | Adhesion Kg | σ |
|---|---|---|---|---|---|---|---|---|---|---|
| 0 | 68.8 | 31.2 | — | — | 3.76 | 167 | 111.6 | −10.8 | 56.5 | 9.5 |
| 1 | 65.8 | 32.6 | 0.75 | 0.85 | 3.91 | 181 | 120 | −2.4 | 64.6 | 16.2 |
| 2 | 65.0 | 32.0 | 2.1 | 0.90 | 3.87 | 185 | 125.5 | +3.1 | 71.6 | 7.7 |
| 3 | 64.1 | 32.0 | 3.0 | 0.90 | 4.05 | 188 | 123.7 | +1.3 | 62.6 | 10.0 |
| 4 | 64.7 | 30.8 | 3.6 | 0.90 | 4.04 | 189 | 124 | +1.6 | 55.6 | 7.2 |
| 5 | 62.6 | 32.0 | 4.5 | 0.90 | 4.16 | 189 | 124 | +1.6 | 53.2 | 11.2 |
| 6 | 61.2 | 31.5 | 6.4 | 0.90 | 4.23 | 189 | 123.8 | +1.4 | 59.4 | 11.7 |
| 7 | 60.0 | 32.1 | 7.0 | 0.90 | 4.19 | 189 | 124.3 | +1.9 | 49.2 | 9.8 |
| 8 | 59.0 | 32.6 | 7.6 | 0.90 | 4.40 | 189 | 122.9 | +0.5 | 51.5 | 10.2 |

Copper and nickel determined by AA, 2 analytical determinations for each one; g/kg 2 determinations; CR: ultimate tensile stress; CRS: specific ultimate tensile stress; CRS reference 122.4; adhesion 15 determinations, ½ inch immersion (about 1.25 cm), time 35', temperature 155 ± 7° C. Rubber mix: the standard mix; σ: standard deviation.

Figure 2:
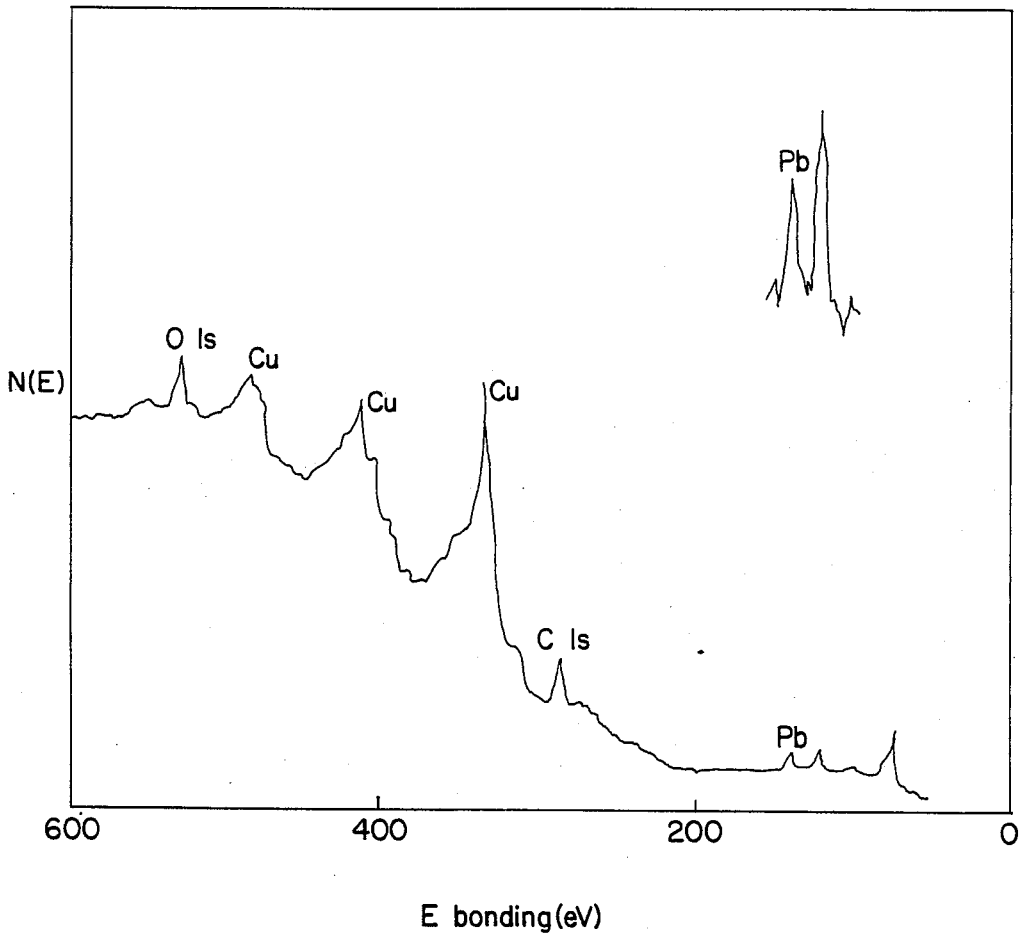
FIG. 2 is a graph showing the analysis of the surface of a coating.

The analysis of the surface of the sample No. 3 carried out by XPS spectrometry shows the lead signal at 144 eV ($E_{bond}$). Such signal is also present after removal of a 400 Å layer by bombardment with 5 keV $Ar^+$, as can be observed in FIG. 2 of the enclosed drawings, wherein the abscissas show the bond energies ($E_{bond}$) in eV and the ordinates show the number of electrons ($N_{(E)}$).

A scanning Auger spectrometry analysis of samples 3 and 7 gave the following results:

Sample 3—Sample 3 consists of an alloy (4.05 g/kg) containing 3% nickel and 0.90% lead. Carbon and oxygen are present on the surface due to atmospheric pollution, and trace amounts of chlorine and sulfur are also present. The surface of the sample is well coated. The composition profile in the first 0.2 μm thickness layer puts into evidence a remarkable homogeneity with respect to Cu and Zn (O and C only are present on the surface and their signals disappear after about one hundred Å); iron is present just in trace amounts at the detectability limit.

Sample 7—The chemical analysis of the coating gives the following average values of nickel and lead concentrations: Ni, 7% of the total amount and Pb 0.90% of the total amount.

The investigations of the state of the surface of sample 7 carried out by Secondary Electron Micrography (SEM) at 500× and 2000× shows the presence of stains which are irregular both as regards their shapes and as regards their depths, as well as of longitudinal striations.

A point-to-point analysis of the first kind of stains (which are on the other hand very rare) showed that the same consisted of surface scales of carbon materials, as the carbon (C 1s) and oxygen (O 1s) signals only were shown to be present in the same. On the contrary, a point-to-point analysis of the nearby zones showed that the coating is made up to Cu, Zn, Ni and Pb.

A compositional map was made of an area comprising one of the observed longitudinal striations. Such analysis was performed for:

(a): copper (peak at 919 eV), (b): nickel (peak at 713 ev), (c): zinc (peak at 992 eV); the analysis showed that copper is absent from said striations whereas only nickel is present therein.

On the contrary zinc and lead are spread almost homogeneously everywhere both inside and outside said longitudinal striations.

Accordingly, it can be concluded that the surface coating of sample No. 7 does not consist of a quaternary alloy but that a full separation of nickel occurs, which nickel has formed an alloy with zinc but not with copper.

The decrease in the adhesion already remarked in Table 4 for sample 7 can be presumably ascribed to such fact, which occurs for a nickel percentage of 7% or higher. This is confirmed by the adhesion result relating to sample 8 (Ni: 7.6%), which also is lower than the value of the standard sample.

Moreover, a compositional profile of sample No. 7 carried out by Auger spectrometry, starting from the coating surface and going towards the coating steel interface showed the presence of significative amounts of oxygen down to about one thousand Å from the surface. The compositional profile of oxygen follows very closely the compositional profile of zinc so that the presence can be suspected of oxide traces also within the mass of the coating itself.

It is to be observed that the steel wire coated with an alloy amount between 2 and 8 g/kg in the presence of 0.75–7% Ni and 0.2–2% Pb can be very easily drawn.

The wire, examined under the electron microscope or by scanning Auger spectrometry after drawing shows a surface homogeneously coated on which quite a negligible number of defects are present.

Analytical tests and adhesion tests carried out on a standard cord made up of four wires of 0.25 mm diameter (average thickness of the coating 0.3 μm) gave results which are reported in Table 5.

TABLE 5

Wire cords of steel coated with Cu/Zn/Ni/Pb

| Test | Analyses and adhesion strengths Chemical analysis | | | | | | | | | |
|---|---|---|---|---|---|---|---|---|---|---|
| | 1.4 mm diam. wire | | | | | Cord 2 + 2 × 0.25 | | | | |
| No. | g/kg | Cu % | Zn % | Ni % | Pb % | g/Kg | Cu % | Zn % | Ni % | Pb % |
| STD | 4.05 | 62.5 | 37.5 | — | — | 3.32 | 69.2 | 30.8 | — | — |
| 9 | 4.34 | 61.0 | 34.2 | 3.9 | 0.9 | 3.92 | 65.5 | 31.4 | 2.1 | 1.0 |
| 10 | 4.55 | 62.3 | 32.0 | 4.9 | 0.8 | 3.46 | 63.7 | 32.4 | 2.8 | 1.1 |
| 11 | 4.49 | 64.1 | 33.4 | 1.6 | 0.9 | 3.67 | 63.3 | 32.4 | 3.2 | 1.1 |
| 12 | 4.37 | 64.1 | 32.5 | 2.4 | 0.9 | 3.48 | 64.3 | 32.4 | 2.2 | 1.1 |
| 13 | 4.50 | 62.4 | 33.8 | 2.9 | 0.9 | 3.64 | 64.4 | 33.2 | 1.3 | 1.1 |

| Test | specific ultimate tensile stress | | adhesion | | | | | |
|---|---|---|---|---|---|---|---|---|
| | | | as obtained (1) | | | after aging (2) | | |
| No. | CRS | ΔCRS | Kg | σ | Δ | Kg | σ | Δ |
| STD | 122.4 | — | 45.6 | 3.5 | — | 23.1 | 3.5 | — |
| 9 | 120.1 | −2.3 | 48 | 4.0 | +2.4 | 24 | 2 | +0.9 |

(1) Average over 18 determinations of two different vulcanizations: reference: cords 2 + 2 × 0.25 with a 69/35 brass coating, 4.2 g/kg (rubber mix: the standard mix, ½ inch immersion (about 1.25 cm), vulcanization 155 ± 1° C. for 35 minutes).

(2) treated with steam for 12 hours on 10% NaCl solution at 120° C.

Samples examined had a percentage amount of lead close to 1% and a percentage amount of nickel between 1.3 and 4.0%. All cord samples show after vulcanization (the standard mix was employed according to the ASTM standard procedure for such tests) a value of the adhesion strengths that is sharply higher than the reference sample value; such improvement in the adhesion strength in some instances is higher than 10%. Moreover, after steam treatment under pressure of a 10% NaCl solution at 120° C. for 4 hours, the adhesion loss is always much lower with respect to the standard sample with a gain in the case of sample No. 11, containing 3.2% Ni and 1% lead, of about 20%.

The present invention has been disclosed with particular reference to some of its specific embodiments but it is to be understood that modifications and changes can be introduced in the same by those who are skilled in the art without departing from its true spirit and scope.

We claim:

1. A process for the production of electroplated steel wires, characterized by the following series of operations:

(a) simultaneously electrodepositing copper and lead from an alloy bath onto a steel wire, (b) electrodepositing zinc from a zinc plating bath, (c) electrodepositing nickel from a nickel plating bath, (d) solid state diffusion by Joule effect of the layers obtained by the electroplating steps (a), (b), and (c), a washing step being provided after each one of the electroplating operations (a), (b) and (c).

2. A process for the production of electroplated steel wires according to claim 1, wherein said simultaneous electrodeposit of copper and lead of step (a) is carried out employing a pyrophosphate alloy bath of the following composition:

$Cu(P_2O_7)_2^{6-}$: 0.3–0.7 moles/l $Pb(P_2O_7)_2^{6-}$: $0.25\times10^{-3}$–$10\times10^{3}$ moles/l $P_2O_7$: 0.1–0.2 moles/l $HP_2O_7^{3-}$: 0.1–0.2 moles/l $NH_3$: 0–0.1 moles/l $NO_3^-$: 0–0.1 moles/l $Cu(HP_2O_7)_2^{5-}$, $CuP_2O_7^{2-}$, $H_2P_2O_7^{-2}$, $Pb(P_2O_7)^{2-}$ trace amounts;

$Cu/P_2O_7$ ratio = 1/7 by weight; pH = 8.8; the bath being kept under the following operative conditions:

temperature = 50±2° C.

current density = 10–20 A/dm².

3. A process for the production of electroplated steel wires according to claims 1 or 2, wherein said zinc electrodeposit step (b) is carried out employing an acid bath of the following composition:

$Zn^{2+}$: 0.7–2.0 moles/l $SO_4^{2-}$: 1.0–2.5 moles/l said bath being kept under the following operative contions:

temperature = 20°–40° C.

current density = 10–20 A/dm² countercurrent stirring.

4. A process for the production of electroplated steel wires according to claims 1 or 2, wherein said nickel electrodeposit of step (c) is carried out from an acid bath of the following compositon:

$Ni^{2+}$: 0.7–1.5 moles/l $SO_4^{2-}$: 0.5–1.3 moles/l $Cl^-$: 0.1–0.5 moles/l $H_3BO_3$: 0.3–0.6 moles/l
pH: 3.5±0.5 said bath being kept under the following operative conditions:

temperature=30°–60° C.
current density=2–10 A/dm$^2$
countercurrent stirring.

5. A pyrophosphate alloy bath for electrodepositing copper and lead on steel, said bath being characterized in that it has the following composition:

$Cu(P_2O_7)_2^{6-}$: 0.3–0.7 moles/l
$Pb(P_2O_7)_2^{6-}$: $0.25\times10^{-3}-10\times10^{-3}$ moles/l
$P_2O_7$: 0.1–0.2 moles/l
$HP_2O_7^{3-}$: 0.1–0.2 moles/l
$NH_3$: 0–0.1 moles/l
$NO_3^-$: 0–0.1 moles/l
$Cu(HP_2O_7)_2^{5-}$, $CuP_2O_7^{2-}$, $H_2P_2O_7^{2-}$, $Pb(P_2O_7)^{2-}$ trace amounts; $Cu/P_2O_7$ ratio=1/7 by weight; pH=8.8.

6. Coated steel wires obtained by the process claimed in any one of claims 1 or 2, said wires being characterized by an alloy coating containing copper, zinc, nickel and lead, of the following average composition:

Cu: 59–70%
Zn: 30–33%
Ni: 0.75–8%
Pb: 0.2–2%.

7. A process for the production of electroplated steel wires according to claim 3, wherein said nickel electrodeposit of step (c) is carried out from an acid bath of the following composition:

$Ni^{2+}$: 0.7–1.5 moles/l
$SO_4^{2-}$: 0.5.1.3 moles/l
$Cl^-$: 0.1–0.5 moles/l
$H_3BO_3$: 0.3–0.6 moles/l
pH: 3.5±0.5 said bath being kept under the following operative conditions:

temperature=30°–60° C.
current density=2–10 A/dm$^2$
countercurrent stirring.

8. Coating steel wires obtained by the process claimed in claim 3, said wires being characterized by an alloy coating containing copper, zinc, nickel and lead, of the following average composition:

Cu: 59–70%
Zn: 30–33%
Ni: 0.75–8%
Pb: 0.2–2%.

9. Coated steel wires obtained by the process claimed in claim 4, said wires being characterized by an alloy coating containing copper, zinc, nickel and lead, of the following average composition:

Cu: 59–70%
Zn: 30–33%
Ni: 0.75–8%
Pb: 0.2–2%.

* * * * *

UNITED STATES PATENT AND TRADEMARK OFFICE

CERTIFICATE OF CORRECTION

PATENT NO. : 4,786,377

DATED : November 22, 1988

INVENTOR(S) : de Filippo et al

It is certified that error appears in the above-identified patent and that said Letters Patent is hereby corrected as shown below:

In the Heading, Item [75],

The assignee should be changed to read:

-- Consiglio Nazionale Delle Ricerche, Rome, Italy
Gencord SpA, Assemini, Italy, part interest--

In the Claims

In claim 2, line 7, change "$10 \times 10^3$" to read $10 \times 10^{-3}$--;

on line 8, change "$P_2O_7$" to read --$P_2O_7^{4-}$ --.

In claim 5, line 6, change "$P_2O_7$" to read $P_2O_7^{4-}$ --.

Signed and Sealed this

Thirty-first Day of October, 1989

*Attest:*

*Attesting Officer*

DONALD J. QUIGG

*Commissioner of Patents and Trademarks*